US008261903B2

(12) United States Patent
Deas et al.

(10) Patent No.: US 8,261,903 B2
(45) Date of Patent: Sep. 11, 2012

(54) MEDIA PRESENTER

(75) Inventors: Scott Deas, Dundee (GB); Gordon Burke, Angus (GB); William G Potts, Angus (GB)

(73) Assignee: NCR Corporation, Duluth, GA (US)

( * ) Notice: Subject to any disclaimer, the term of this patent is extended or adjusted under 35 U.S.C. 154(b) by 4 days.

(21) Appl. No.: 12/977,201

(22) Filed: Dec. 23, 2010

(65) Prior Publication Data

US 2012/0161386 A1 Jun. 28, 2012

(51) Int. Cl.
*G07F 7/04* (2006.01)

(52) U.S. Cl. ..... 194/344

(58) Field of Classification Search ..... 194/344, 194/346, 350; 902/8, 9, 10, 12, 13, 14, 15, 902/30; 271/1, 3.03, 145, 162, 163, 207, 271/213; 198/860.1, 860.2, 861.1, 615, 860.3; 221/29, 45, 46, 175; 414/788.1, 789, 789.9, 414/790.2, 751.1, 753.1; 209/534; 270/30.01, 270/30.05, 30.06

See application file for complete search history.

(56) References Cited

U.S. PATENT DOCUMENTS

| | | | | |
|---|---|---|---|---|
| 6,276,603 | B1 * | 8/2001 | Patterson | 235/379 |
| 7,624,977 | B2 * | 12/2009 | Lee et al. | 271/3.01 |
| 2009/0166957 | A1 * | 7/2009 | Kong et al. | 271/198 |

* cited by examiner

*Primary Examiner* — Mark Beauchaine
(74) *Attorney, Agent, or Firm* — Paul W. Martin

(57) ABSTRACT

A media presenter configurable for use in either a front access or a rear access dispenser is described. The media presenter comprises a chassis including a central track defining a central handle end and a central pick end. A nose is coupled to the chassis at the central pick end, and includes (i) a presenting end distal from the chassis and (ii) a nose track arranged to couple to the central track. A removable track is coupled to the chassis and extends from a handle end of the chassis to the central handle end. The nose track, the central track, and the removable track combine to provide a presenting track extending from the handle end to the presenting end. The presenter can present media items to a customer in a rear access dispenser, or can be reconfigured by exchanging the positions of the nose and removable track to present media items in a front access dispenser.

10 Claims, 13 Drawing Sheets

FIG. 4
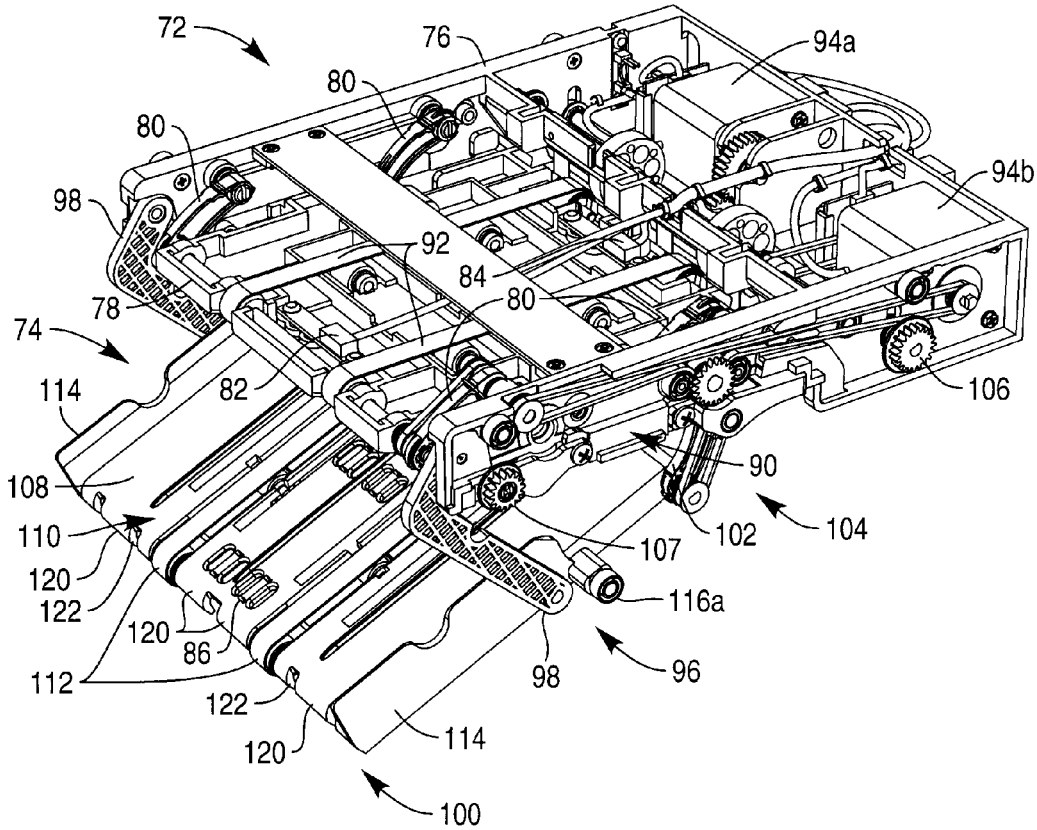
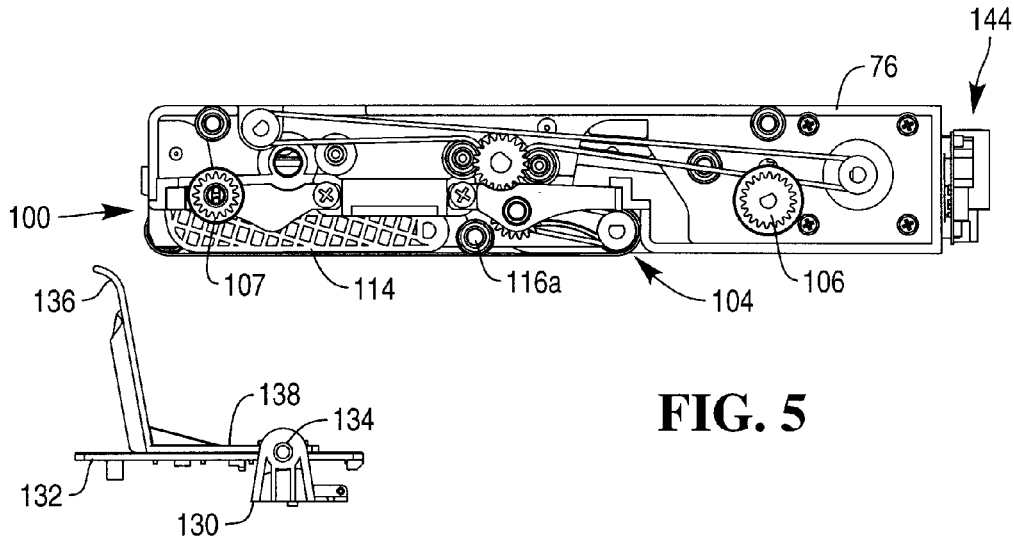
FIG. 5

FIG. 8
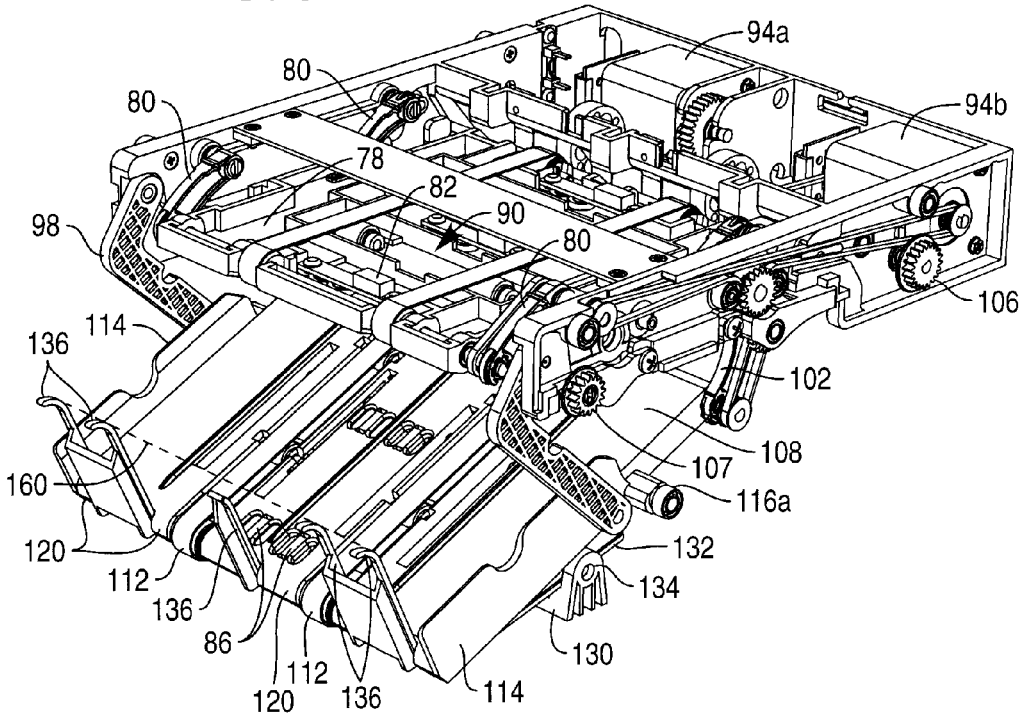
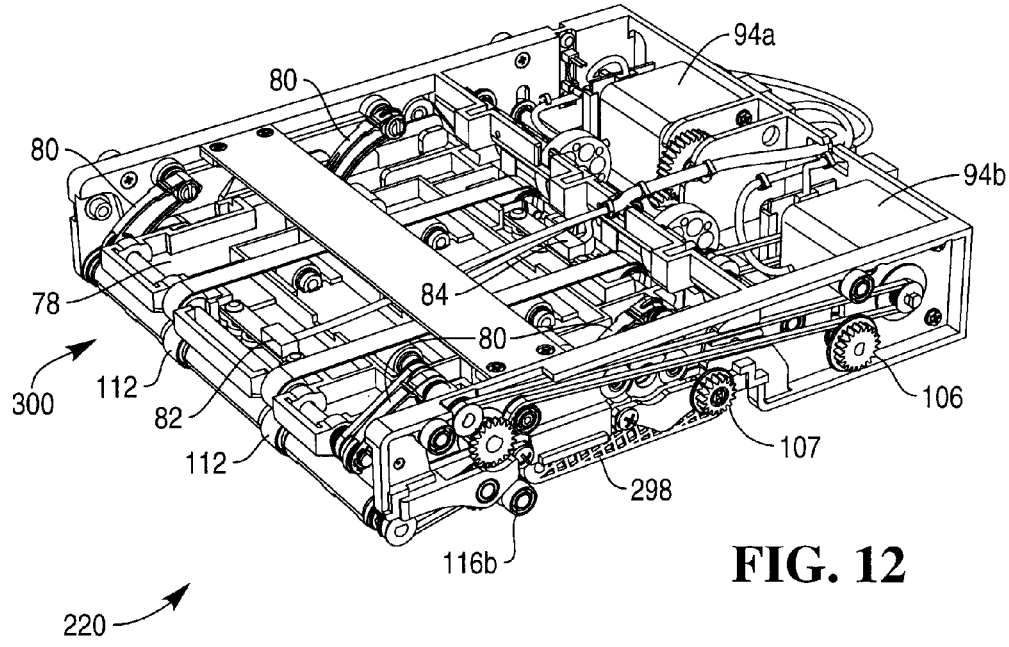
FIG. 12

MEDIA PRESENTER

FIELD OF INVENTION

The present invention relates to improvements in or relating to a media presenter.

BACKGROUND OF INVENTION

A media presenter is used as part of a media dispenser. A media presenter is that part of the dispenser that presents media items to a customer. One common type of media dispenser is a bunch sheet media dispenser for dispensing a bunch (or stack) of media items in sheet form (such as banknotes, tickets, coupons, and the like).

A bunch media presenter is typically coupled to one or more media pick units. Each media pick unit picks individual media items from a media cassette (or a hopper) stored therein, and transports the picked media item to the media presenter for collating the media items into a bunch (for example, using a ballistic stacker or a stacking wheel), and then presenting the bunch of media items to a customer. If the customer does not remove the presented bunch, then the presenter withdraws the bunch and transports it to a purge bin.

Some media dispensers are front access, which means that media cassettes are inserted into the media dispenser at the same side of the media dispenser at which media items are dispensed to a customer. Other media dispensers are rear access, which means that media cassettes are inserted into a media dispenser at the opposite side of the media dispenser at which media items are dispensed to a customer.

It would be desirable to provide an improved media item presenter. It would also be desirable to provide a media item presenter that could be used with either a front access or a rear access media dispenser, with only minor modifications, so that the same parts could be used for either media presenter. Having a large number of common parts would reduce manufacturing and servicing costs because a lower inventory of parts would be needed.

SUMMARY OF INVENTION

Accordingly, the invention generally provides methods, systems, and apparatus for a reversible media presenter.

In addition to the Summary of Invention provided above and the subject matter disclosed below in the Detailed Description, the following paragraphs of this section are intended to provide further basis for alternative claim language for possible use during prosecution of this application, if required. If this application is granted, some aspects may relate to claims added during prosecution of this application, other aspects may relate to claims deleted during prosecution, other aspects may relate to subject matter never claimed. Furthermore, the various aspects detailed hereinafter are independent of each other, except where stated otherwise. Any claim corresponding to one aspect should not be construed as incorporating any element or feature of the other aspects unless explicitly stated in that claim.

According to a first aspect there is provided a media presenter configurable for use in either a front access or a rear access dispenser, the media presenter comprising: a chassis including a central track defining a central handle end and a central pick end; a nose coupled to the chassis at the central pick end, and including (i) a presenting end distal from the chassis, (ii) a nose track arranged to couple to the central track, and (iii) an overlapping portion extending from the central pick end to a pick end of the chassis; a removable track coupled to the chassis and extending from a handle end of the chassis to the central handle end, wherein the nose track, the central track, and the removable track combine to provide a presenting track extending from the handle end to the presenting end, and the distance between the handle end and the central handle end is approximately equal to the distance between the central pick end and the pick end; wherein the presenter can present media items to a customer in a rear access dispenser, or the presenter can be reconfigured by exchanging the positions of the nose and removable track to present media items to a customer in a front access dispenser.

The media presenter may further comprise: a carriage mounted on the presenting track for movement therealong, and comprising a carriage body coupled to a carriage plate and being arranged (i) to maintain a stack of media items between the carriage body and the carriage plate, and (ii) to transport the stack of media items out of the carriage via either a front access present path at a handle side of the carriage, or a rear access present path at a pick side of the carriage.

The chassis may comprise a pair of opposed central tracks, each defining a central handle end and a central pick end; the nose may comprise a pair of opposed nose tracks; and a pair of removable tracks may also be provided, so that two, parallel, presenting tracks are provided, one on either side of the carriage.

The nose may further comprise a removable snout for coupling to the nose track and extending the presenting end when a longer nose is needed for a rear access dispenser than for a front access dispenser.

The media presenter may further comprise a first buffer removably coupled to the removable track at a first stop position, and a second buffer removably coupled to the nose track at a second stop position proximal the presenting end; wherein each of the first and second buffers can be removed to allow the carriage to be moved beyond either the first or second stop positions, respectively, to allow the carriage to be removed from the presenting track.

The carriage may include a sensor aligned with the presenting track for sensing targets mounted on the presenting track as the carriage moves along the presenting track.

By virtue of this aspect, a media presenter can be configured with the nose at either end of the chassis (and the removable track at the opposite end of the chassis to the nose), so that the media presenter can be used on either a front access dispenser or a rear access dispenser.

According to a second aspect there is provided a media presenter that is reversible for use with either a front access or a rear access dispenser, the media presenter comprising: a chassis including a central track defining a first end and a second end; a nose coupled to the chassis at one of the first or second ends of the central track and including (i) a presenting end distal from the chassis, and (ii) a nose track arranged to couple to the central track to provide a continuous track from the chassis to the presenting end; and a removable track coupled to the chassis at the other of the first or second ends of the central track; the combination of the central track, the nose track, and the removable track co-operating to provide a presenting track that extends from one end of the chassis, through the opposite end of the chassis, and to the presenting end.

The presenting track may comprise a linear, toothed rack for engaging with a toothed wheel on a movable carriage.

The central track may extend from an end of the chassis opposite the nose (the blank end) to the nose end of the chassis. Alternatively, the media presenter may comprise a removable track mounted on the chassis at the blank end, and arranged to couple to, and align with, the central track to provide a presenting track that extends from the blank end of the chassis, through the nose end of the chassis, and to the presenting end of the nose. The removable track may be of similar dimensions to the portion of the nose that is in contact with the chassis. This allows the media presenter to be configured with the nose at either end of the chassis (and the removable track at the opposite end of the chassis to the nose), so that the media presenter can be used on either a front access dispenser or a rear access dispenser.

The media presenter may further comprise a carriage mounted on the presenting track for movement therealong, and comprising a carriage body coupled to a carriage plate by a linkage, the carriage plate being movable between an open position at which media items can be placed on the carriage plate, and a closed position for clamping media items between the carriage plate and the carriage body.

The carriage body may comprise: a carriage chassis; an upper plate mounted on the carriage chassis and resiliently biased towards the carriage plate; an upper transport section mounted to the upper plate and including a plurality of stretchable belts; and a motor mounted on the carriage chassis and above the upper plate.

The carriage plate may further comprise: a lower transport section including a plurality of stretchable belts, and the motor is operable to control the upper transport section and the lower transport section to transport a bunch of media items out of either a pick end of the carriage or a handle end of the carriage, opposite the pick end.

The motor may be operable to transport the bunch of media items out of (i) the handle end when the bunch of media items is to be transported to a purge container, and (ii) the pick end when the bunch of media items is to be presented to a customer.

The linkage may comprise (i) a first pair of link arms coupling the carriage plate to the carriage body at a media entrance end, and (ii) a second pair of link arms coupling the carriage plate to the carriage body at a non-entrance end opposite the entrance end.

The motor may be mounted to the chassis at a mounting point that is distal from the media entrance end of the carriage and proximal to the non-entrance end of the carriage.

The carriage chassis may be reversible so that, when the carriage chassis is reversed, the motor mounting point is proximal to the media entrance end of the carriage and distal from the non-entrance end of the carriage.

The nose track, the central track, and the removable track may each provide a track shelf portion arranged to support a portion of a carriage. The portion of the carriage may comprise a cam follower (for example, in the form of a bearing (such as a plain or ball bearing) mounted on a pin, rod, or other shaft, the mounted bearing extending laterally from the carriage plate).

The media presenter may further comprise a registration device coupled to the chassis and for maintaining media items placed on the carriage plate in alignment when the carriage plate is in the open position.

The registration device may comprise a plurality of fingers extending above the carriage plate when the carriage plate is in the open position, the plurality of fingers being (i) pivotably coupled to the chassis, and (ii) resiliently biased towards the carriage plate.

The carriage plate may further comprise a bumper at the media entrance end arranged to deflect the plurality of fingers when the carriage plate is moved to the open position to allow media items to be transported over the plurality of fingers and placed on the carriage plate.

The fingers may be disposed and arranged so that when fully deflected by the bumper, the fingers provide a registration edge against which media items rest after being placed on the carriage plate.

The carriage plate may traverse a closure path when moved back to the closed position, and the fingers may urge against the bumper and maintain the media items as a stack in registration on the carriage plate during a first portion of the closure path, and the fingers may cease contact with the bumper and the media item stack during a second portion of the closure path.

The linkage may move the carriage plate from (i) a relatively steep angle, at which gravity causes the media items to slip, during the first portion of the closure path to (ii) a relatively shallow angle, at which gravity does not cause the media items to slip, during the second portion of the closure path.

The central track may also define a cam block gap in its track shelf portion.

The media presenter may further comprise a media item transport unit arranged to receive a picked media item from a pick unit and to transport the picked media item to the carriage when the carriage plate is in the open position. The media item transport unit may be operable to divert a transported media item to a purge compartment of a purge bin if the media item does not meet an acceptance criterion (such as the media item being thicker than permitted, which may indicate multiple superimposed media items being transported as a single item, the media item being skewed, the media item being torn, or the like).

The media item transport unit may further comprise: a media item thickness sensor for detecting multiple superimposed media items, skewed media items, and the like. The media item thickness sensor may use an optical, mechanical and/or magnetic system to detect the thickness of a media item. Media item thickness sensors are well known.

The media items may comprise banknotes, tickets, coupons, or the like.

According to a third aspect there is provided a media dispenser comprising a pick unit coupled to the media presenter of the first aspect.

According to a fourth aspect there is provided a self-service terminal incorporating the media dispenser of the third aspect. The self-service terminal may be an automated teller machine.

According to a fifth aspect there is provided a media presenter that is reversible for use with either a front access or a rear access dispenser, the media presenter comprising: a chassis including a central track defining a coupling at each of two opposing ends; a removable presenter including a track extending therealong and defining a coupling at one end for engaging with either of the two central track couplings; and a removable track defining a coupling at one end for engaging with either of the two central track couplings.

The central track couplings may comprise one or more protrusions. The removable presenter coupling may comprise one or more recesses complementary to the one or more central track protrusions. The removable track coupling may comprise one or more recesses complementary to the one or more central track protrusions.

The complementary couplings may, for example, provide a snap-fit, an interference fit, or may be secured by a screw.

For clarity and simplicity of description, not all combinations of elements provided in the aspects recited above have been set forth expressly. Notwithstanding this, the skilled person will directly and unambiguously recognize that unless it is not technically possible, or it is explicitly stated to the contrary, the consistory clauses referring to one aspect are intended to apply mutatis mutandis as optional features of every other aspect to which those consistory clauses could possibly relate.

These and other aspects will be apparent from the following specific description, given by way of example, with reference to the accompanying drawings.

BRIEF DESCRIPTION OF THE DRAWINGS

FIG. 4 is a perspective view of part (the carriage) of the media presenter of FIG. 1 in an open position;

FIG. 5 is a side view of the carriage of FIG. 4 in a closed position and another part (the registration device) of the media presenter of FIG. 1;

FIG. 8 is a perspective view of the carriage and registration device of FIG. 5, with the carriage in the open position and engaged with the registration device;

FIG. 12 is an upper perspective view of part (the carriage) of the media presenter of FIG. 11 in a closed position;

Figure 1:
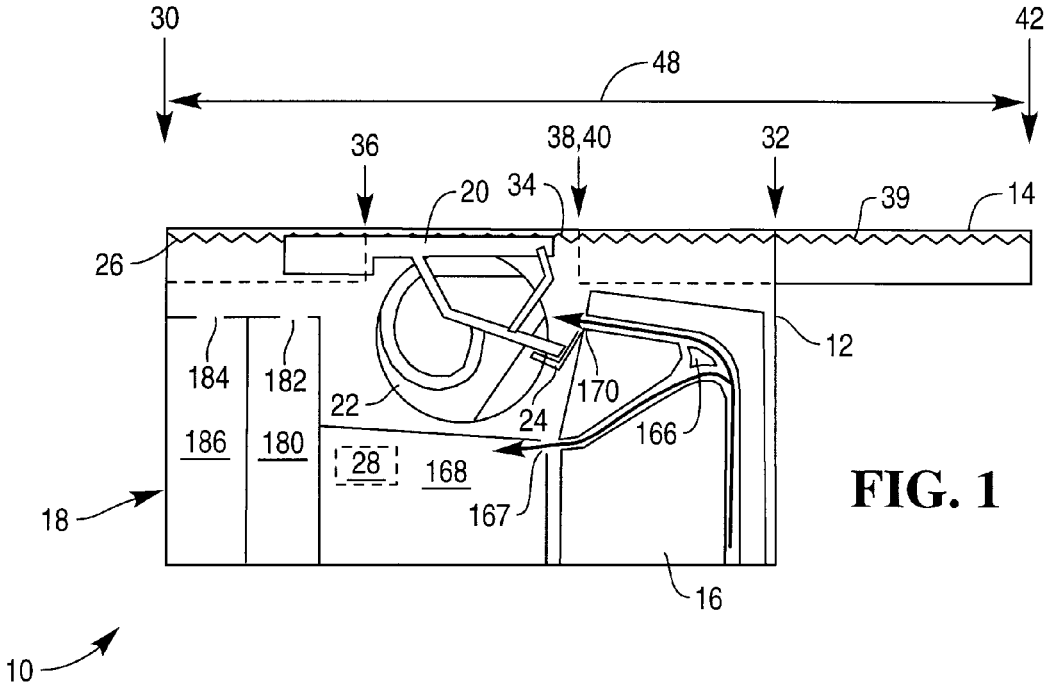
FIG. 1 is a simplified schematic diagram of a rear access media item presenter according to one embodiment of the present invention.

It should be appreciated that some of the drawings provided are based on computer renderings from which actual physical embodiments can be produced. As such, some of these drawings contain intricate details that are not essential for an understanding of these embodiments but will convey useful information to one of skill in the art. Therefore, not all parts shown in the drawings will be referenced specifically. Furthermore, to aid clarity and to avoid numerous leader lines from cluttering the drawings, not all reference numerals will be shown in all of the drawings. In addition, some of the features are removed from some views to further aid clarity.

Reference is first made to FIG. 1, which is a simplified schematic diagram of a rear access media item presenter 10 (in the form of a banknote presenter) according to one embodiment of the present invention.

The banknote presenter 10 comprises: a chassis 12, a removable nose 14, a banknote transport unit 16 for coupling to a pick unit (not shown) of a dispenser (not shown), a multi-compartment purge bin 18, a carriage 20, a cam block 22, a registration device 24, a removable track 26, and a control board (shown by dotted line 28).

The chassis 12 extends from a handle end 30 (which is the end at which currency cassette handles are located) to a pick end 32 (which is the end that aligns with a transport from a pick unit (not shown). The chassis 12 includes a central track 34 located centrally on an upper area thereof and extending from a central handle end 36 to a central pick end 38.

The removable nose 14 includes a nose track 39 extending from a coupling end 40 of the nose 14 to a presenting end 42 of the nose 14, and aligning with the central track 34 to provide a continuous track therealong.

When mounted in position, the removable track 26 extends from the handle end 30 to the central handle end 36. The distance between the handle end 30 and the central handle end 36 is approximately equal to the distance between the central pick end 38 and the pick end 32.

In the rear access presenter 10, the removable track 26 is mounted at the handle side of the chassis 12; whereas, in a front access presenter (described below), the removable track 26 is mounted at a picking end of the chassis 12.

The removable track 26, the central track 34, and the nose track 39 are all linearly aligned and coupled so that they combine to provide a presenting track (illustrated by arrow 48) extending from the handle end 30 of the chassis 12 to the presenting end 42 of the nose 14. The carriage 20 is linearly moveable along the length of the presenting track 48.

Although only one presenting track 48 is illustrated, the presenter 10 includes two removable tracks 26 and two central tracks 34, and the removable nose 14 includes two nose tracks 39, so that the chassis 12 includes two parallel presenting tracks 48, each located on an opposite side of the chassis 12. The carriage 20 simultaneously engages with both presenting tracks 48 (each of two opposing sides of the carriage 20 engages with a different one of the presenting tracks 48). However, for clarity only one presenting track 48 is illustrated in FIG. 1.

Figure 2A:
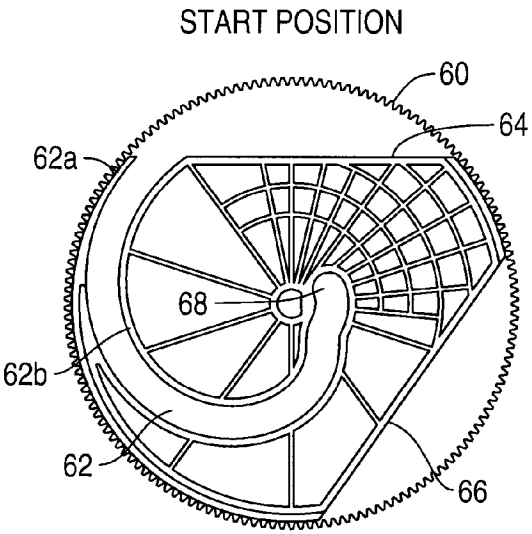
FIGS. 2A to 2C are diagrams illustrating a part (the cam block) of the media item presenter of FIG. 1 in three different operational positions.
Figure 2B:
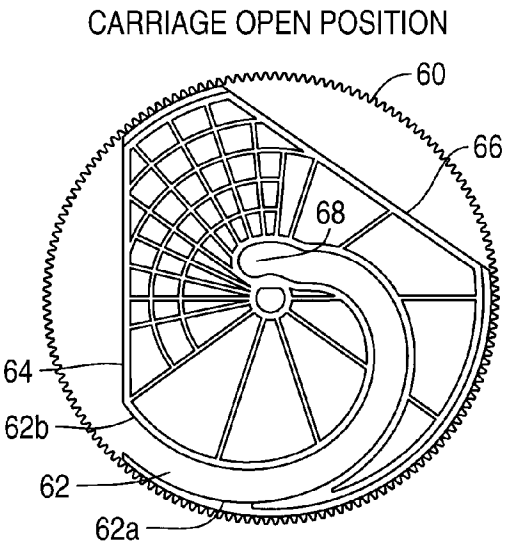
Figure 2C:
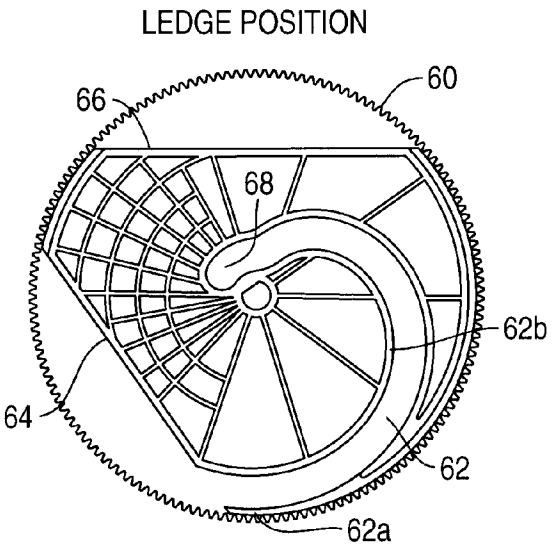

Reference will now also be made to FIGS. 2A to 2C, which are three diagrams illustrating the cam block 22 in three different operational positions.

The cam block 22 comprises a circular block of plastics material. The cam block 22 includes a toothed circumference 60 for receiving drive from a cam motor (not shown) driven by the control board 28. This enables the cam block 22 to be rotated either clockwise or anti-clockwise, as desired.

The cam block 22 defines a curved cam track 62, a straight lead-in track 64 extending from a point on the circumference of the cam block 22 to the curved track 62, and a ledge track 66 extending from one point of the circumference of the cam block 22 to an opposite point on the circumference of the cam block 22 (that is, the ledge track 66 is a chord). The curved cam track 62 ends at an offset centre point 68. The curved cam track 62 includes a downwards cam surface 62*a* (for moving a cam follower down) opposite an upwards cam surface 62*b* (for moving a cam follower up).

Figure 3A:
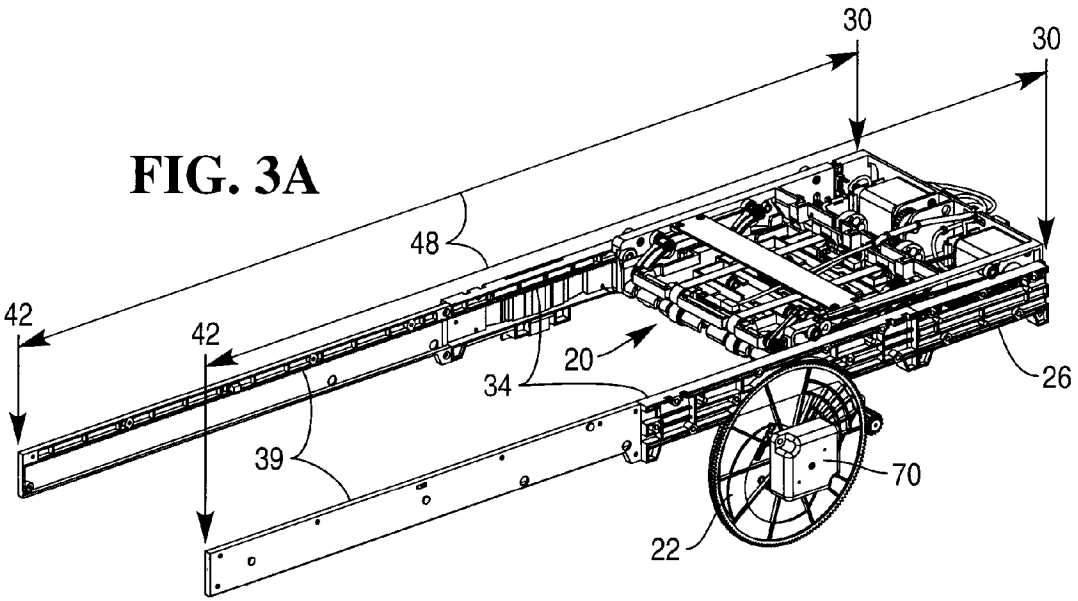
FIGS. 3A to 3D are diagrams illustrating other parts (the presenting track, the cam block, and the carriage) of the media item presenter of FIG. 1 in four different positions.
Figure 3B:
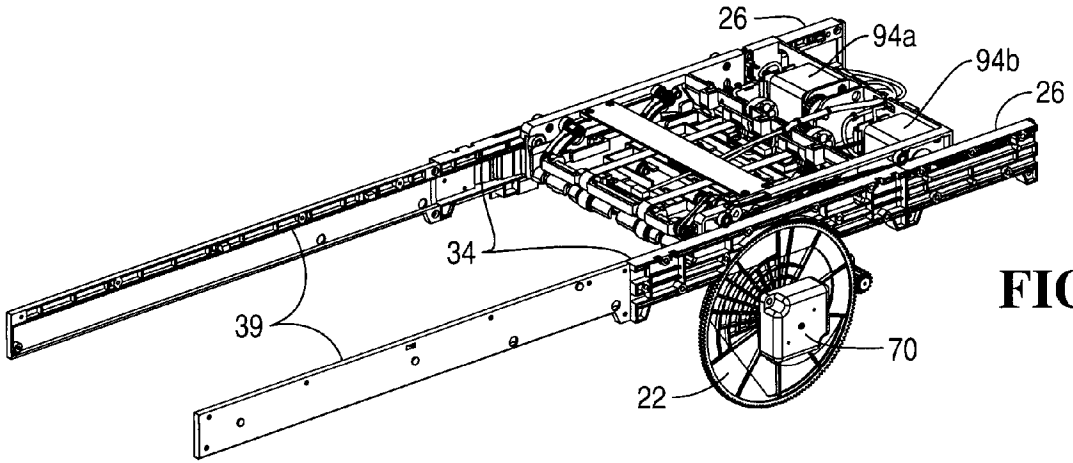
Figure 3C:
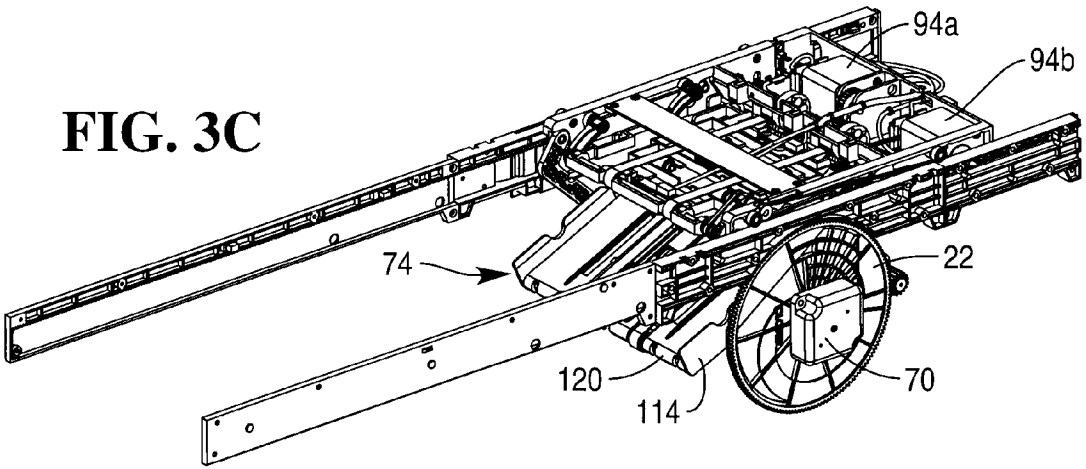
Figure 3D:
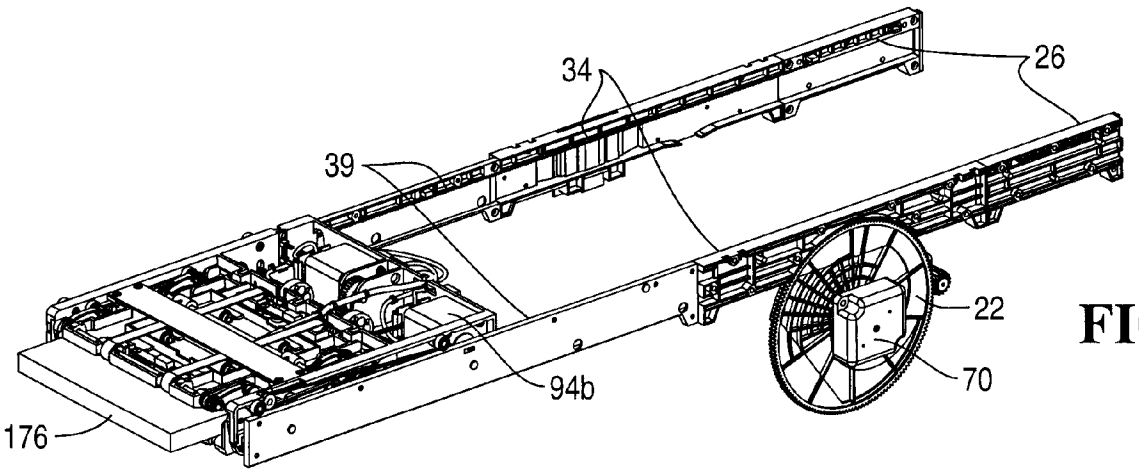

Reference will now also be made to FIGS. 3A to 3D, which illustrate the presenting track 48, the cam block 22, and the carriage 20 in four different positions. The four positions are: present purge position (FIG. 3A); loading position, carriage closed (FIG. 3B); loading position, carriage open (FIG. 3C); and present position (FIG. 3D).

FIGS. 3A to 3D show the presenting track 48 (formed by the nose track 32, the central track 34, and the removable track 26), the cam block 22, a cam block position sensor 70, and the carriage 20 mounted on the presenting track 48 for linear movement therealong. The cam block position sensor 70 may use a magnetic sensor that co-operates with a magnetic target mounted on a shaft on which the cam block 22 is mounted. This enables the cam block position sensor 70 to sense the rotational position of the shaft, and thereby deduce the rotational position of the cam block 22.

FIG. 3A shows the carriage 20 at the present purge position, which is used for transporting a bunch of banknotes into the purge bin 18, where the bunch of banknotes was presented to a customer but was not removed by the customer, as will be described in more detail below.

FIG. 3B shows the carriage 20 at the loading position with the carriage 20 in the closed position. At the loading position, the cam block 22 can be rotated by the cam block motor (not shown) until the cam block 22 is at the cam start position, as shown in FIG. 2A.

FIG. 3C also shows the carriage 20 at the loading position with the carriage 20 in the open position. To move the carriage 20 from the closed position to the open position, the cam block 22 is rotated until it is at the carriage open position, as shown in FIG. 2B.

The carriage 20 will now be described in more detail with reference to FIG. 4, which is a perspective view of the carriage 20 in the open position.

The carriage 20 comprises: a carriage body 72 and a carriage plate 74 movable between an open position at which banknotes can be placed on the carriage plate 74, and a closed position for clamping banknotes between the carriage plate 74 and the carriage body 72.

The carriage body 72 further comprises: a carriage chassis 76; an upper plate 78 coupled to the carriage chassis 76 by four sprung arms 80 that resiliently bias the upper plate 78 towards the carriage plate 74; a first banknote sensor 82; a second banknote sensor 83 (not visible in FIG. 4), and a third banknote sensor 84; an upper transport section (shown generally by arrow 90) mounted to the upper plate 78 and including a plurality of stretchable belts 92; and a pair of motors 94*a,b* mounted on the carriage chassis 76 for moving the carriage 20 along the presenting track 48 (motor 94*a*) and for energizing the upper transport section 90 (motor 94*b*).

The carriage body 72 is coupled to the carriage plate 74 by a linkage (shown generally by arrow 96). The linkage 96 comprises a pair of link arms (entrance link arms) 98 coupling the carriage plate 74 to the carriage body 72 at one end (the media entrance end) 100 and a pair of link arms (non-entrance link arms) 102 coupling the carriage plate 74 to the carriage body 72 at the opposite end (the non-entrance end) 104.

The entrance link arms 98 are longer than the non-entrance link arms 102 to ensure that the entrance end 100 is lower than the non-entrance end 104 when the carriage is open.

Each of the banknote sensors 82,83,84 includes a light source aligned with a corresponding prism 86 (only one of the two prisms is shown in the drawings). The first and third banknote sensors 82,84 can detect any banknotes present at the media entrance end 100 or the non-entrance end 104.

The carriage body 72 also includes two pairs of drive cogs 106, each drive cog pair 106 being mounted on a shaft extending from one each side of the carriage chassis 76 to the other side of the carriage chassis 76. The drive cogs 106 engage with the presenting tracks 48 and are rotated by one of the pair of motors 94 (the carriage moving motor 94*a*) to move the carriage 20 either forwards (towards the presenting end 42) or backwards (towards the handle end 30) along the presenting track 48, depending on the direction of rotation of the carriage moving motor 94*a*. In addition, two laterally offset stabilizing cogs 107 are provided, one on each side of the chassis, for engaging with the presenting track 48. The stabilizing cogs 107 are not driven, but are used to prevent the carriage 20 from skewing as it moves along the presenting tracks 48.

The carriage plate 74 further comprises: an upper surface 108, a lower transport section 110 (including a pair of stretchable endless belts 112), a pair of sidewalls 114 upstanding from the lower transport section (shown generally by arrow 110) and a cam follower (in the form of plain bearing mounted on a pin) 116 extending laterally from the sidewalls 114 and into the presenting track 48. There are actually two pin-mounted bearings 116*a,b*, one on each side of the carriage plate 74; however, only one of these (pin mounted bearing 116*a*) is used as a cam follower. The other pin-mounted bearing 116*b* is not used as a cam follower, but it is used to maintain the carriage plate 74 in the closed position as the carriage 20 moves along the presenting track 48 (other than at the loading position).

The carriage plate 74 further comprises a bumper 120 at the media entrance end 100 defining a plurality of recesses 122.

Reference will now also be made to FIGS. 5 to 8, which are illustrations of the carriage 20 and the registration device 24 from different viewpoints.

The registration device 24 comprises a bracket 130 coupled to the chassis 12; a support plate 132 pivotably coupled to the bracket 130 by a pair of pivot points 134; and a plurality of fingers (front edge fingers) 136 mutually coupled to a base 138, which is slidably coupled to the support plate 132 by a spring (not shown) that biases the front edge fingers 136 towards the pivot points 134. In addition, the pivot points 134 include a spring (not shown) to bias the support plate 132 towards a generally horizontal position, as shown in FIG. 5.

The front edge fingers 136 are disposed on the base 130 to align with the recesses 122 on the carriage plate 74.

When the carriage plate 74 is moved to the open position then the front edge fingers 136 interlace with the bumper 120 by entering the bumper recesses 122 (best shown in FIG. 8).

Drive circuitry 144 is provided on the carriage 20 to control the motors 94. The drive circuitry 144 is connected to the control board 28 by a flexible umbilical connector (not shown).

Figure 9:
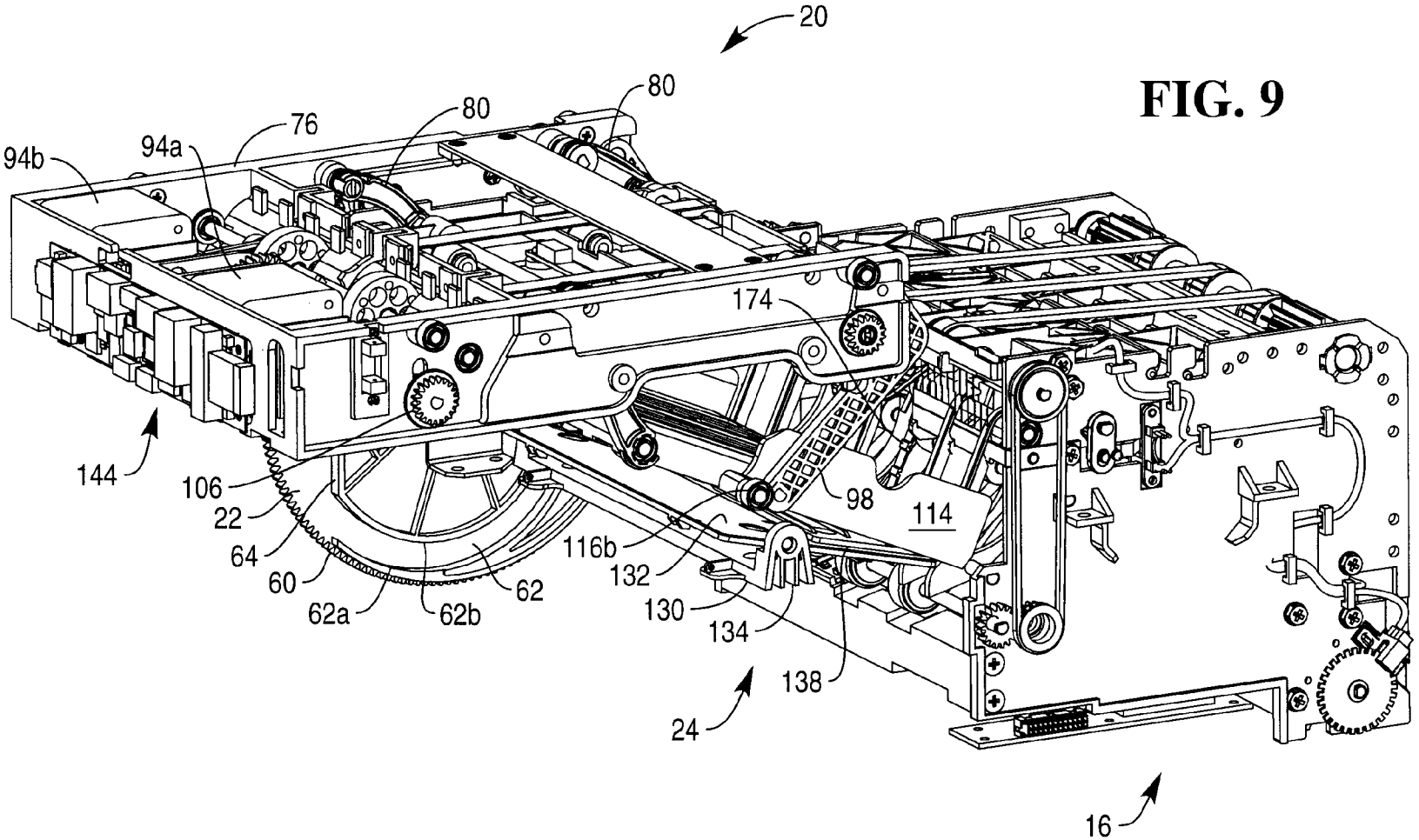
FIG. 9 is a perspective view of those parts (the carriage, the cam block, the registration device, and the media transport unit) of the media presenter of FIG. 1 that are used to create a bunch of media items.
Figure 10:
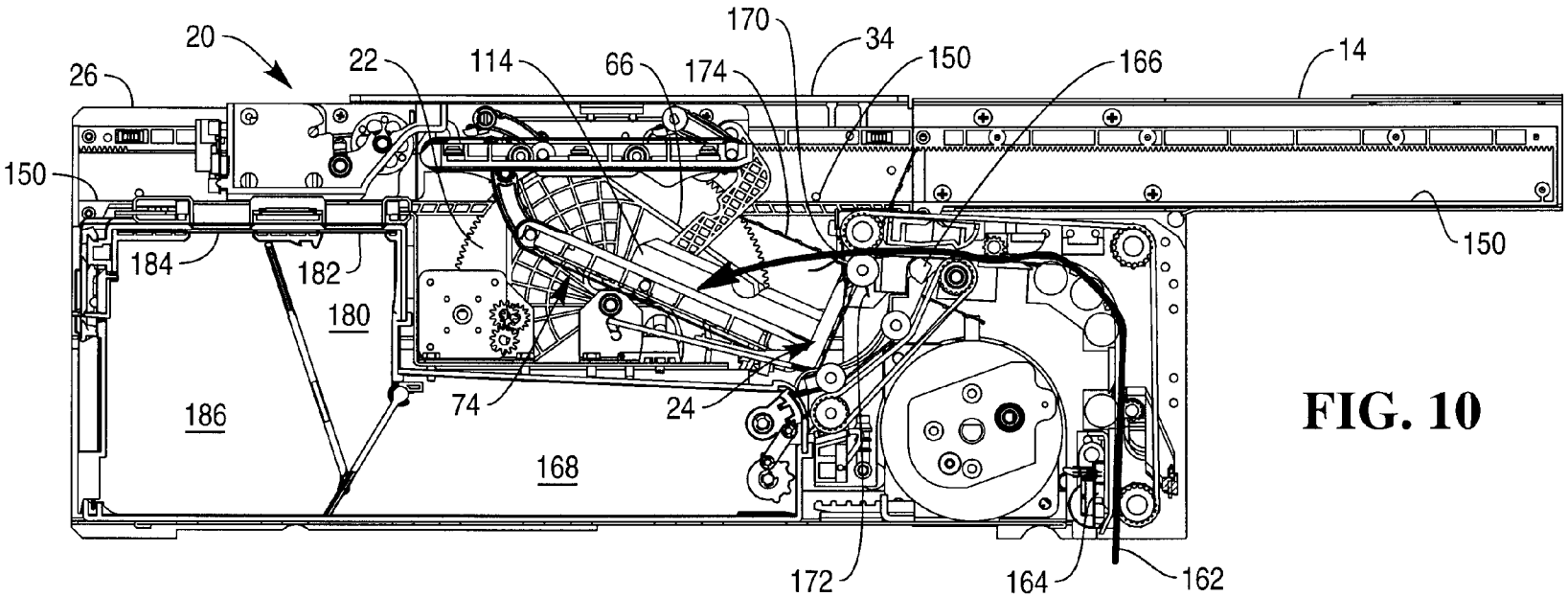
FIG. 10 is a side view of the media presenter of FIG. 1.
Figure 13:
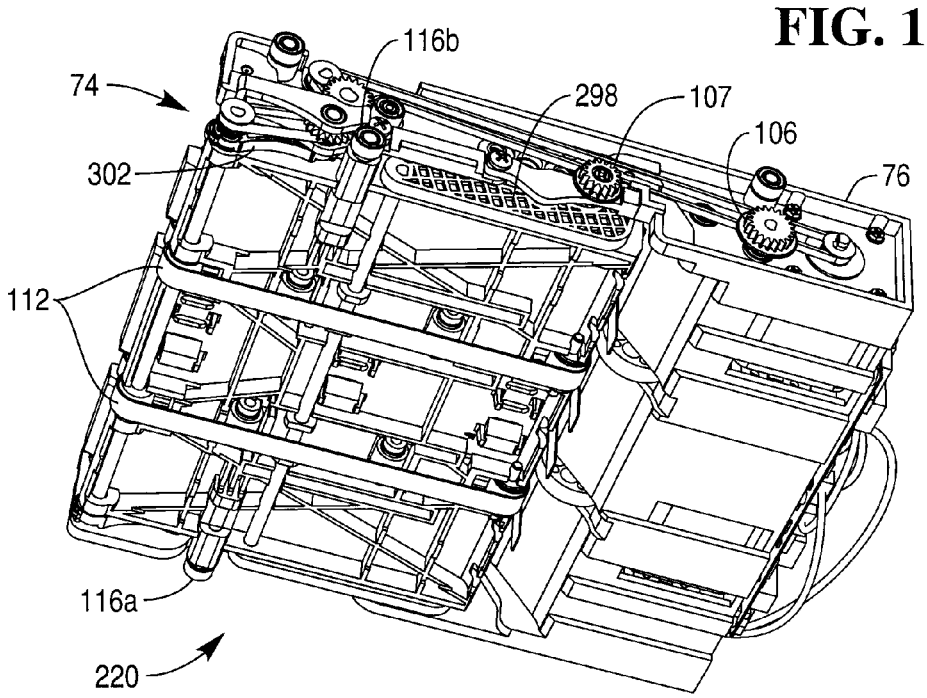
FIG. 13 is a lower perspective view of the carriage of FIG. 12 in a closed position.

Reference is again made to FIGS. 3A to 3D, to FIG. 3E, and also to FIGS. 9 and 10, which illustrate the carriage 20 in the open position interlaced with the registration device 24 and aligned with the banknote transport unit 16.

Figure 3E:
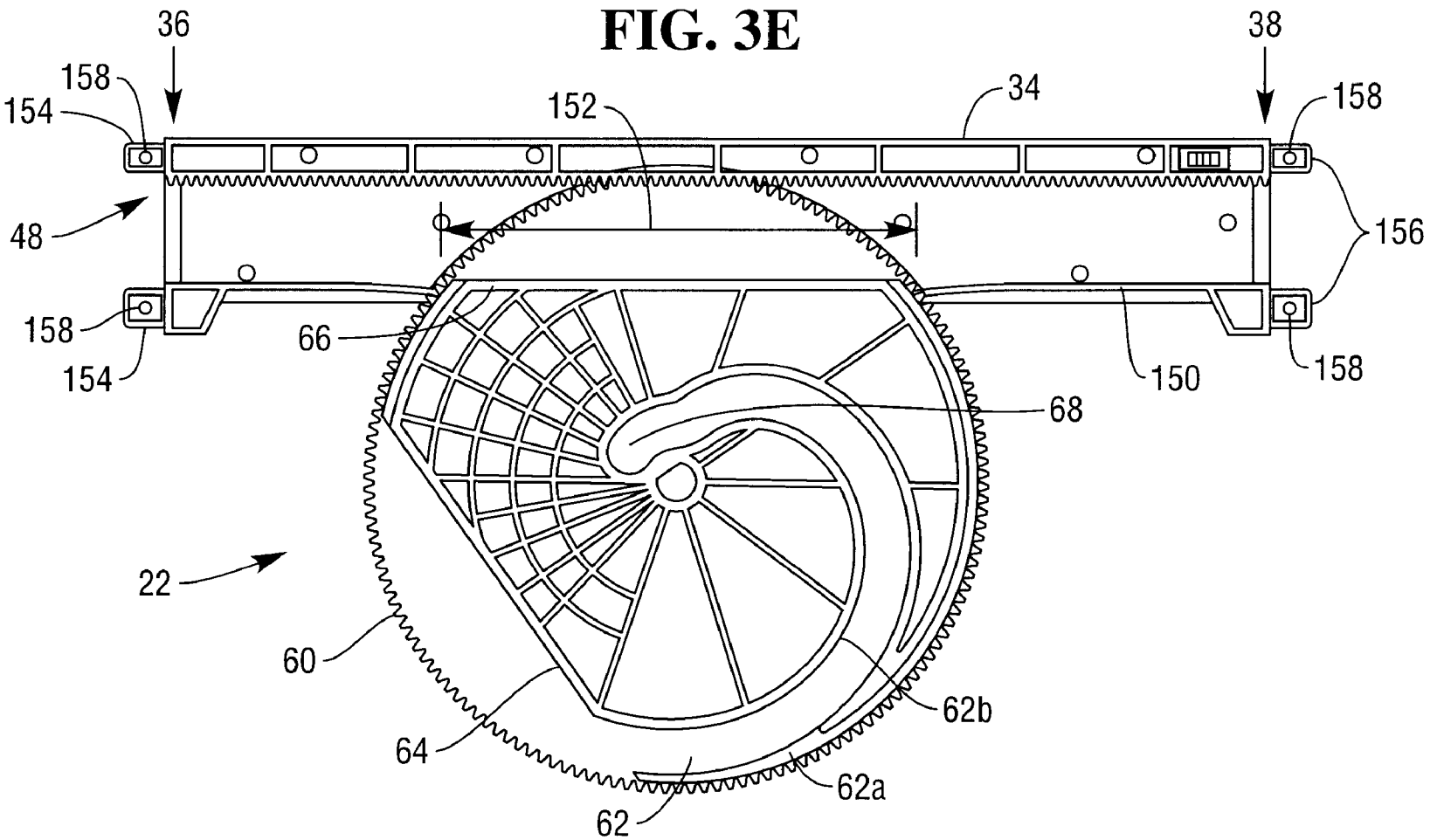
FIG. 3E is a diagram illustrating the cam block and part of the presenting track, with the cam block in a ledge position.
Figure 6:
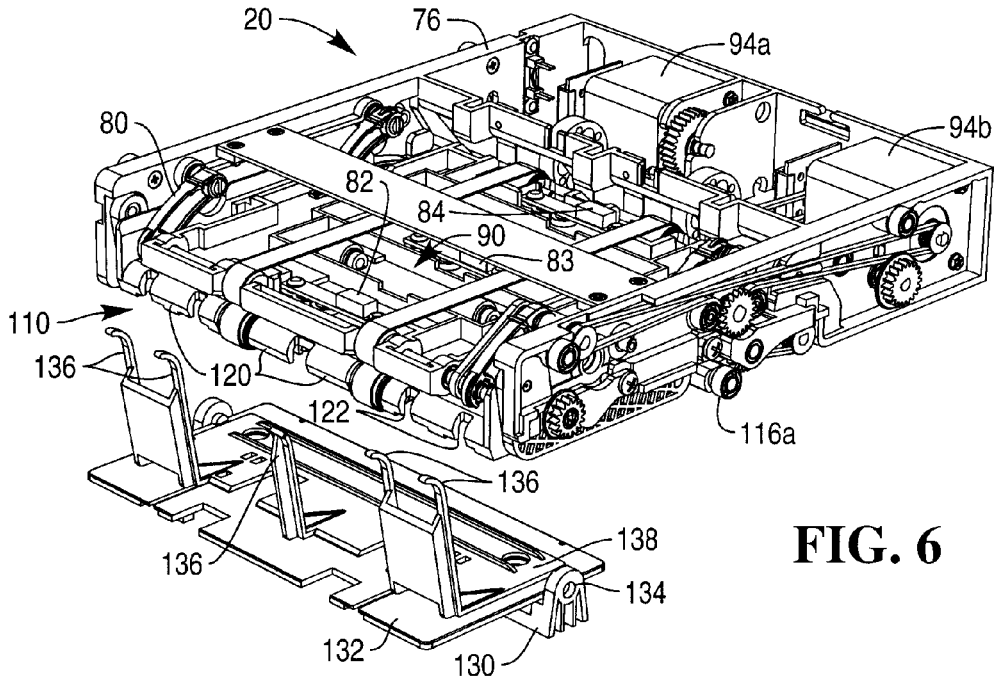
FIG. 6 is a perspective view of the carriage and registration device of FIG. 5, with the carriage in the closed position.

The presenting track 48 includes a track shelf 150 (best seen in FIG. 10) extending from the presenting end 42 to the handle end 30 except for a cam block gap 152 (FIG. 3E).

As illustrated in FIG. 3E, the central track 34 defines a pair of protrusions 154 at the central handle end 36 and a pair of protrusions 156 at the central pick end 38. The protrusions 154 are dimensioned to be accommodated within complementary recesses (not shown) in the removable track 26 and the removable nose 14. Similarly, the protrusions 156 are dimensioned to be accommodated within complementary recesses (not shown) in the removable track 26 and the removable nose 14. The protrusions 154,156 include threaded apertures 158 that align with apertures (not shown) in the removable track 26 and the removable nose 14 so that mounting screws (not shown) can be inserted to secure the central track 34 to both the removable track 26 and the removable nose 14 to provide a secure, unitary presenting track 48.

Reference is also made to FIGS. 2A to 2C. When the carriage 20 is moved along the presenting track 48, the track shelf 150 prevents the carriage plate 74 from opening. However, there is a gap (the cam block gap 152) in the track shelf 150. This gap can be filled by aligning the ledge track 66 with the track shelf 150. This occurs when the cam block 22 is rotated to the straight track (or ledge) position, as shown in FIG. 2C. The ledge position is attained by rotating the cam block 22 anti-clockwise from the start position (FIG. 2A) by approximately 55 degrees.

When the cam block 22 is in the ledge position (FIG. 2C), the carriage 20 can be moved from the presenting end 42 to the handle end 30 without the carriage plate 74 opening.

If, however, the cam block 22 is rotated to the start position (as shown in FIG. 2A), then the track shelf 150 is only partially completed by the lead-in track 64. If the carriage 20 is moved towards the handle end 30 sufficiently, then the cam follower 116*a* will drop into the cam track 62. However, this is not desirable because moving the carriage plate 74 from the closed position to the open position can be controlled more accurately by stopping the carriage 20 at the junction of the cam track 62 and the lead-in track 64. When the cam follower 116*a* is at the junction of the cam track 62 and the lead-in track 64, then the carriage 20 is in the loading position.

When the carriage 20 is in the loading position, clockwise rotation of the cam block 22 by approximately 270 degrees will cause the cam follower 116*a* to move downwards (by the action of the downward cam surface 62*a* pushing an upper surface of the cam follower 116*a* down) until the cam follower 116*a* reaches the offset centre point 68, at which point the carriage 20 is in the open position (as shown in FIGS. 2B, 3C, 4 and 7 to 10).

As the carriage plate 74 moves towards the carriage open position, the bumper 120 engages with the registration device 24 and interlaces the bumper recesses 122 with the front edge fingers 136. Continued movement of the carriage plate 74 to the open position causes the bumper 120 to pivot the support plate 132 downwards (best seen in FIG. 7) and to urge the base 138 away from the pivot points 134. This causes the front edge fingers 136 to provide a registration edge 160 (illustrated by a broken line in FIG. 8) against which banknotes can be stacked.

Stacking of banknotes on the carriage plate 74 will now be described with reference to FIGS. 9 and 10, which illustrate the banknote transport unit 16 aligned with the carriage 20 in the open position and the registration device 24 fully deflected by the bumper 120.

The banknote transport unit 16 defines a main banknote path 162 (illustrated by an arrow line in FIG. 10) using co-operating stretchable endless belts and rollers (not referenced individually).

The banknote transport unit 16 includes a conventional banknote (note) thickness sensor (NTS) 164 to sense the thickness of each banknote being transported, and to detect any skew of a banknote being transported. The banknote transport unit 16 also includes a divert gate 166 (best shown schematically in FIG. 1). The divert gate 166 is activated to divert any banknote failing the banknote thickness sensor test (implemented by the NTS 164) through an exit aperture 167 in a single banknote purge compartment 168 of the purge bin 18. A banknote may fail the banknote thickness sensor test, for example, because multiple banknotes are being transported as a single banknote, because a banknote has an unacceptably large hole, or because a banknote is skewed beyond an acceptable amount.

If a banknote is not diverted from the main transport path 162 then it is ejected from an exit port 170 of the main banknote path 162 onto the carriage plate 74. The banknote transport unit 16 includes first banknote flickers 172 (difficult to see, but just visible in FIG. 10) at the exit port 170 to flick media items towards the media entrance end 100 of the carriage 20 as banknotes exit the main banknote path 162. The first banknote flickers 172 are relatively short and impart forward acceleration to the banknotes being ejected from the banknote transport unit 16.

The banknote transport unit 16 also includes second banknote flickers 174 at the exit port 170 that are longer than the first banknote flickers 172. The second banknote flickers 174 flick banknotes downwards onto the carriage plate 74 after the banknotes have been ejected from the main banknote path 162.

Each banknote that is sprayed out of the exit port 170 and onto the carriage plate 74 has its lower long edge aligned with the registration edge 160 due partly to the force of gravity acting on the banknote but mostly because of the second banknote flickers 174 urging the sprayed banknote towards the registration edge 160.

Once all of the desired banknotes have been sprayed onto the carriage plate 74, then the cam block 22 can be rotated back to the start position (as shown in FIG. 2A). This involves the cam block motor (not shown) rotating the cam block 22 by approximately 270 degrees in the anti-clockwise direction. When this occurs, the upwards cam surface 62*b* pushes a lower surface of the cam follower 116*a* upwards until the cam follower 116*a* reaches the junction of the cam track 62 and the lead-in track 64. As the cam follower 116*a* rises, the support plate 132 moves back towards a generally horizontal position (due to the spring in the pivot points 134) and the base 138 is urged towards the pivot points 134 by the base spring (not shown). This causes the front edge fingers 136 to track the carriage plate 74 and maintain the registration edge 160 in contact with the stack of banknotes on the carriage plate 74 for part (a first portion) of the carriage plate's path from the closed position to the open position (referred to herein as the closure path).

The entrance link arms 98 and the non-entrance link arms 102 are dimensioned to ensure that the carriage plate 74 (and the stack of banknotes resting thereon) approaches the upper plate 78 at a shallow angle during a second portion of the closure path. This ensures that the stack of banknotes does not slide off the carriage plate 74 when the front edge fingers 136 cease to provide the registration edge 160 for the stack of banknotes. The point at which the front edge fingers 136 cease to contact the banknote stack defines the end of the first portion of the closure path and the start of the second portion of the closure path.

At the end of the closure path, when the carriage plate 74 approaches the upper plate 78, the sprung arms 80 ensure that an appropriate force is applied by the upper plate 78 to most or all of the top surface of the topmost banknote in the stack. This prevents any pinching of the edge of the stack of banknotes. Pinching of the edge of the stack would cause the stack to splay, thereby making the stack more difficult to present reliably to a customer.

When the carriage plate 74 has reached the closed position, the presenter 10 is ready to present the bunch (or stack) of banknotes to a customer.

This is implemented by the carriage moving motor 94*a* rotating the drive cogs 106 on each side of the carriage chassis 76 to move the carriage 20 to the present position (FIG. 3D). When the carriage 20 has reached the present position (as confirmed by position sensors (not shown)), then the belt transport motor 94*b* drives the upper and lower transport sections 90,110 to transport the bunch of banknotes (illustrated as bunch 176 in FIG. 3D) partially out of the media entrance end 100 for removal by a customer.

If the customer removes the banknote bunch then this is detected by the first banknote sensor 82 (which ceases to detect the presence of banknotes at the media entrance), and the carriage moving motor 94*a* drives the carriage 20 back to the loading position, as shown in FIG. 3B.

If the customer does not remove the banknote bunch (or only removes some of the banknotes in the bunch) then this is detected by the first banknote sensor 82 (which continues to detect banknotes at the media entrance). The belt transport motor 94*b* drives the upper and lower transport sections 90,110 in reverse to transport the bunch of banknotes 176 back so that they are fully within the carriage 20.

The control board 28 then moves the carriage 20 to the present purge position (FIG. 3A) using the carriage moving motor 94*a* and the drive cogs 106.

To implement this, it is necessary for the carriage 20 to travel along the presenting track 48 beyond the loading position towards the blank end 44. To be able to do this, the cam block gap 152 must be closed. This is achieved by rotating the cam block 22 to the ledge position, as shown in FIG. 2C. When this has been done, then the carriage 20 can be moved beyond the loading position to the present purge position.

When at the present purge position, the upper and lower transport sections 90,110 transport the bunch of banknotes out of the carriage 20 via the non-entrance end 104 and into a present bunch purge compartment 180 (best shown by FIGS. 1 and 10) of the purge bin 18 via a present bunch slot 182 defined in an upper surface of the purge bin 18. The third banknote sensor 84 detects when the bunch of banknotes 176 has exited the carriage 20. When this occurs, the banknote bunch 176 enters the present bunch slot 182, and the carriage 20 is moved back to the loading position by the control board 28 driving the carriage moving motor 94*a* to rotate the drive cogs 106.

In this embodiment there is a second purge position (the non-present purge position), which is closer to the handle end 30 than the present purge position. This is used for any purge operations in which the bunch of banknotes 176 is never presented to a customer (and therefore there was no possibility of customer fraud). The carriage 20 is located at the second purge position when the non-entrance end is aligned with a non-present bunch slot 184 defined by an upper surface of the purge bin 18. The non-present bunch slot 184 is located above a non-present bunch purge compartment 186. There are a number of reasons why the non-present bunch purge compartment 186 may be used. For example, if insufficient banknotes are available to complete a bunch of banknotes, if there is a power fail during a stacking operation, if the single banknote purge compartment 168 is full and a transported banknote in the banknote transport unit 16 needs to be diverted to the purge bin 18, if a customer cancels the transaction before the bunch is presented, if there is a fault with one of the components and an auto-recovery process needs to be implemented, or if there is an attempted fraud prior to presenting the bunch.

By having separate compartments for bunches of banknotes that were purged because they were not removed by customers, and bunches that were purged because of an internal problem with the cash dispenser, it is easier to identify and reconcile those transactions that were possibly due to customer fraud (that is, the customer removing some but not all banknotes in a bunch).

It will now be appreciated that the presenter 10 described above allows a bunch of banknotes to be loaded into the carriage 20 in a controlled manner, and the carriage 20 can then be moved to a presenting position (FIG. 3D) to present the bunch of banknotes to a customer, or to a present purge position (FIG. 3A) if the customer does not remove all of the banknotes in the bunch.

Figure 11:
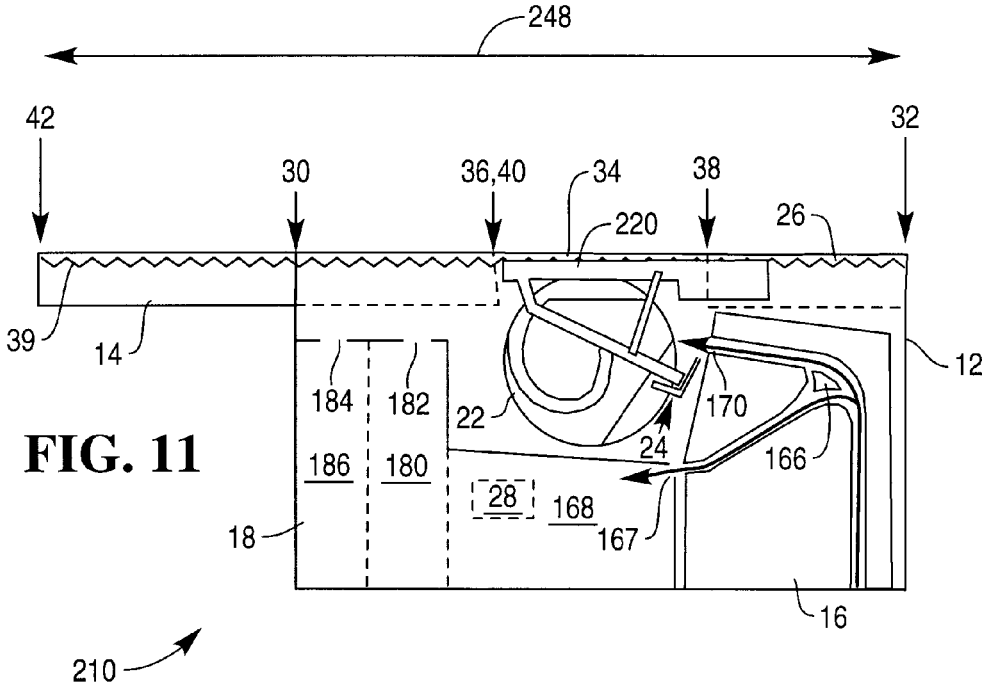
FIG. 11 is a simplified schematic diagram of a front access media item presenter, reconfigured from the rear access media item presenter of FIG. 1, according to another embodiment of the present invention.

The presenter 10 described above also has the advantage that it can be reconfigured for use in a front access dispenser, as will now be described with reference to FIG. 11, which is a simplified schematic diagram of a front access banknote presenter 210 according to another embodiment of the present invention.

The parts used in the presenter 210 are almost all identical to those of banknote presenter 10.

In presenter 210, the chassis 12, the banknote transport unit 16, the purge bin 18, the cam block 22, the registration device 24, and the central track 34 are identical to the corresponding parts in the presenter 10. The same reference numerals have been used because the parts are identical.

The difference between presenter 210 and presenter 10 is that: (i) the carriage 220 in presenter 210 is configured differently to the carriage 20 in presenter 10; (ii) the removable nose 14 in presenter 210 is located on the opposite side of the chassis 12 to the removable nose 14 in presenter 10; and (iii) the removable track 26 in presenter 210 is located on the opposite side of the chassis 12 to the removable track 26 in presenter 10.

The removable nose 14 and the removable track 26 are identical to the corresponding parts in presenter 10, their positions are just exchanged, so they will not be described in detail herein. However, this means that the presenting end 42 is on the opposite side of the presenter 210 to the presenting end 42 of presenter 10. The new presenting track 248 is the same length as presenting track 48 but protrudes from the opposite side of the presenter to presenting track 48.

The carriage 220 is configured differently to the carriage 20, although the same parts are used.

Reference is now made to FIGS. 12 to 18, which are drawings of the carriage 220 from different views. Carriage plate 74 is unchanged, but the carriage body 272 has been rotated through 180 degrees (relative to carriage body 72). In addition, the linkage has been reconfigured.

Figure 7:
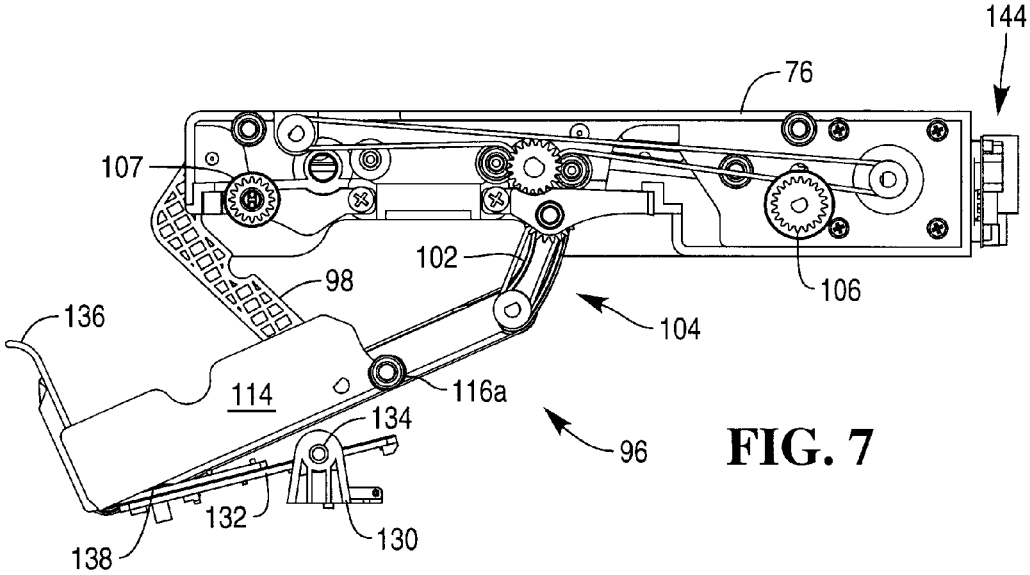
FIG. 7 is a side view of the carriage and registration device of FIG. 5, with the carriage in the open position.
Figure 14:
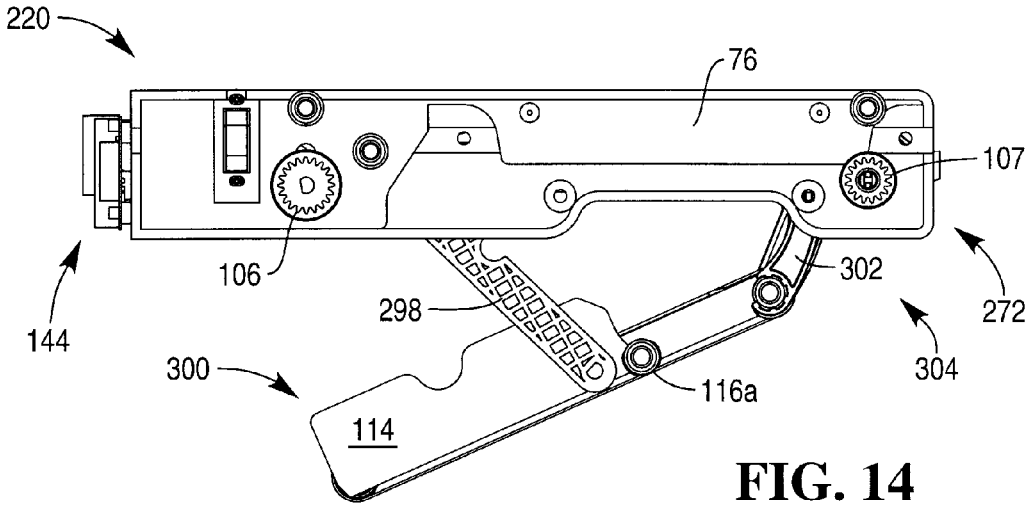
FIG. 14 is a left-side view of the carriage of FIG. 12 in an open position.
Figure 15:
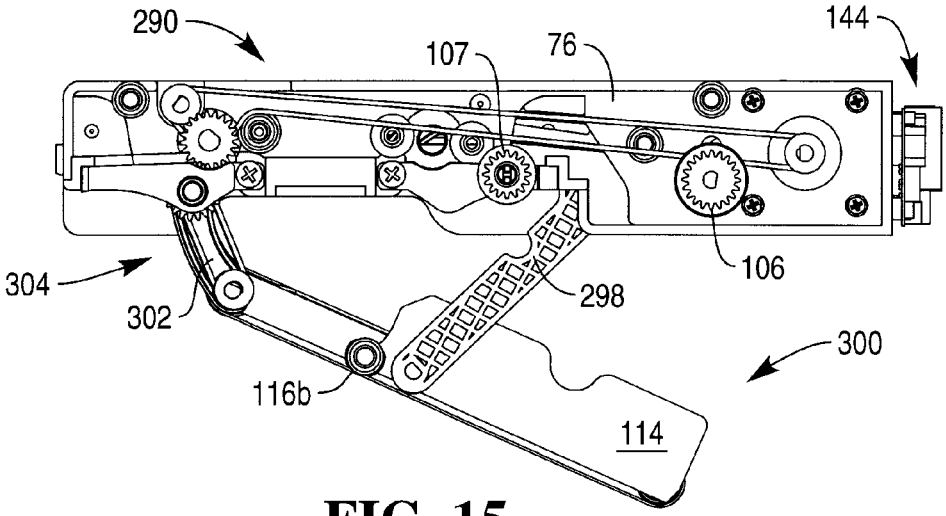
FIG. 15 is a right-side view of the carriage of FIG. 12 in the open position.
Figure 16:
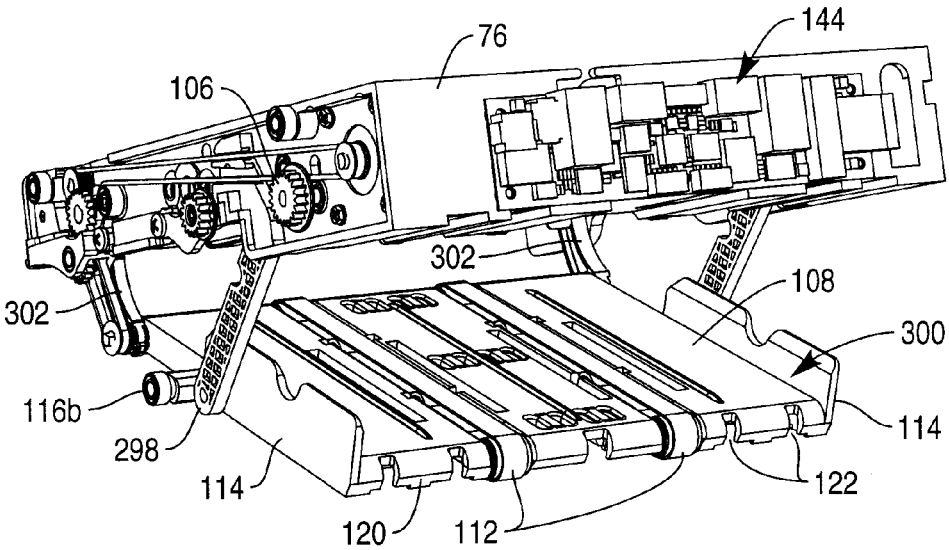
FIG. 16 is a view from the front and to one side of the carriage of FIG. 12 in the open position.
Figure 17:
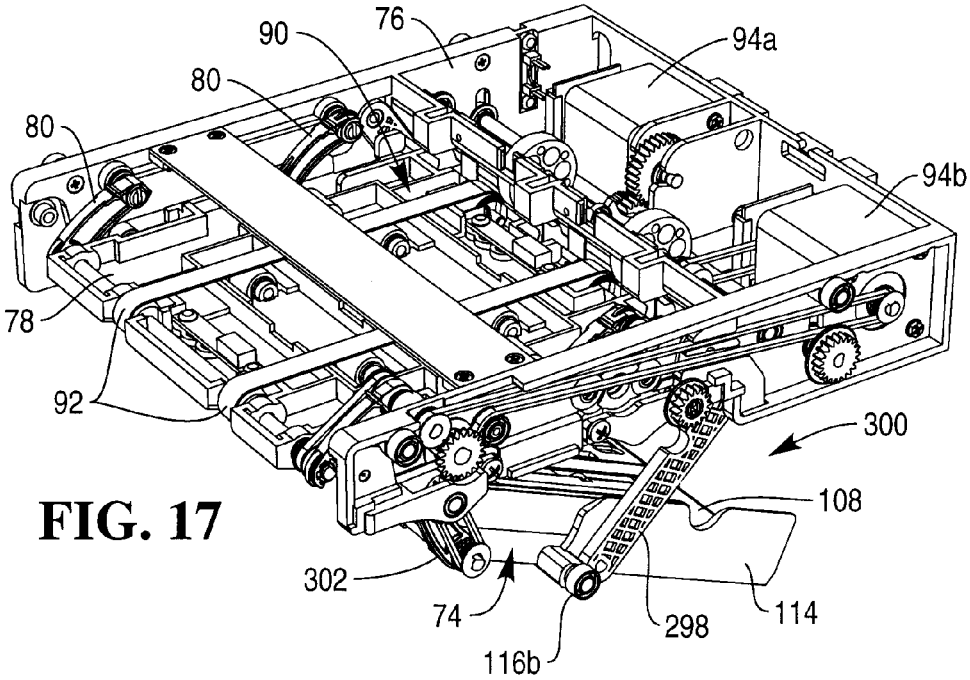
FIG. 17 is a view from the rear and to one side of the carriage of FIG. 12 in the open position.
Figure 18:
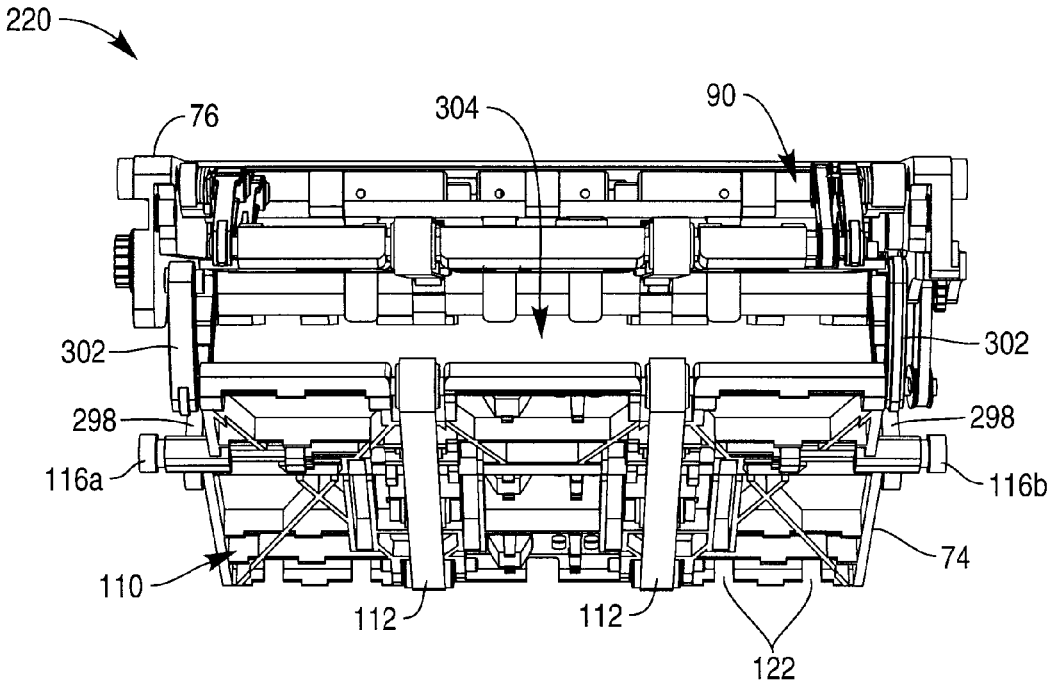
FIG. 18 is a view from the rear of the carriage of FIG. 12 in the open position.

In carriage 20, the entrance link arms 98 are mounted further away from the pair of motors 94 than the non-entrance link arms 102; whereas, in carriage 220, the entrance link arms 298 are mounted nearer the pair of motors 94 than the non-entrance link arms 302 (Best seen by comparing FIGS. 14 and 15 with FIG. 7). This is because the entrance end 100 in carriage 20 is distal from the pair of motors 94; whereas, the entrance end 300 in carriage 220 is proximal the pair of motors 94.

Link arms 98 are identical to link arms 298, the only difference is that they are connected to the carriage body 72,272 at different places. Similarly, the link arms 102 are identical to link arms 302, the only difference is that the link arms 102 couple to one place on the carriage body 72 and the link arms 302 coupled to a different place on the carriage body 272.

The upper transport section 290 is configured slightly differently to the upper transport section 90 because of the routing of some of the belts that drive the stretchable endless belts 92. Although two pin-mounted bearings 116*a,b* are provided on the carriage plate 74, only one of the pin-mounted bearings 116*a* operates as a cam follower. The other pin-mounted bearing 116*b* is used to keep the carriage plate 74 in the closed position and to facilitate transport of the carriage 220 along the new presenting track 248.

The operation of the carriage 220 is the same as that of carriage 20, so will not be described in detail.

It should now be appreciated that the same parts can be used to create a presenter for use in a front access dispenser or a rear access dispenser. Furthermore, by exchanging the positions of a removable nose and a removable track, and by reconfiguring a carriage, a presenter can be transformed from a front access presenter to a rear access presenter and vice versa.

Various modifications may be made to the above described embodiment within the scope of the invention, for example, in other embodiments, the presenter may be used for media items other than banknotes, such as coupons, tickets, passes, vouchers, or the like.

In other embodiments, a different linkage may be used than that described, for example, sliding arms.

In other embodiments, the cam block may have a different shape to that described, for example, square.

In other embodiments, the presenter may include only a single presenting track, not a pair of presenting tracks between which the carriage is mounted.

In the above embodiments, a cam follower is provided on both sides of the carriage plate so that the carriage can be used when rotated through 180 degrees. However, in other embodiments, if a carriage is only ever to be used in one configuration, then only one cam follower may be provided; such a cam follower would be mounted on the side of the carriage plate nearest the cam block.

In the above embodiments, the single banknote purge compartment is separated from the present bunch banknote purge compartment and the non-present bunch purge compartment by dividing walls. In other embodiments, the purge bin may comprise a unitary area having one entrance slot for the single banknote purge operation and another slot for both bunch banknote purge operations.

In other embodiments, a set of removable noses of different lengths may be provided so that the required length of nose can be used. This may be useful where the media presenter is to be used in different self-service terminals, and the self-service terminals have different distances between a dispenser aperture on a fascia and the media dispenser chassis.

The steps of the methods described herein may be carried out in any suitable order, or simultaneously where appropriate.

The terms "comprising", "including", "incorporating", and "having" are used herein to recite an open-ended list of one or more elements or steps, not a closed list. When such terms are used, those elements or steps recited in the list are not exclusive of other elements or steps that may be added to the list.

What is claimed is:

1. A media presenter configurable for use in either a front access or a rear access dispenser, the media presenter comprising:

a chassis including a central track defining a central handle end and a central pick end;

a nose coupled to the chassis at the central pick end, and including (i) a presenting end distal from the chassis, (ii) a nose track arranged to couple to the central track, and (iii) an overlapping portion extending from the central pick end to a pick end of the chassis; and a removable track coupled to the chassis and extending from a handle end of the chassis to the central handle end;

wherein the nose track, the central track, and the removable track combine to provide a presenting track extending from the handle end to the presenting end, and the distance between the handle end and the central handle end is approximately equal to the distance between the central pick end and the pick end so that the presenter can present media items to a customer in a rear access dispenser, or the presenter can be reconfigured by exchanging the positions of the nose and removable track to present media items to a customer in a front access dispenser.

2. A media presenter according to claim 1, wherein the media presenter further comprises: a carriage mounted on the presenting track for movement therealong, and comprising a carriage body coupled to a carriage plate and being arranged (i) to maintain a stack of media items between the carriage body and the carriage plate, and (ii) to transport the stack of media items out of the carriage via either a front access present path at a handle side of the carriage, or a rear access present path at a pick side of the carriage.

3. A media presenter according to claim 2, wherein the chassis comprises a pair of opposed central tracks, each defining a central handle end and a central pick end; the nose comprises a pair of opposed nose tracks; and two removable tracks are provided, so that two, parallel, presenting tracks are provided, one on either side of the carriage.

4. A media presenter according to claim 1, wherein the nose further comprises a removable snout for coupling to the nose track and extending the presenting end when a longer nose is needed.

5. A media presenter according to claim 1, wherein the media presenter further comprises a first buffer removably coupled to the removable track at a first stop position, and a second buffer removably coupled to the nose track at a second stop position proximal the presenting end; wherein each of the first and second buffers can be removed to allow the carriage to be moved beyond either the first or second stop positions, respectively, to allow the carriage to be removed from the track.

6. A media presenter according to claim 1, wherein the media presenter further comprises a media item transport unit arranged to receive a picked media item from a pick unit.

7. A media presenter according to claim 6, wherein the media item transport unit comprises a banknote transport unit.

8. A media presenter that is reversible for use with either a front access or a rear access dispenser, the media presenter comprising:

a chassis including a central track defining a first end and a second end;

a nose coupled to the chassis at one of the first or second ends of the central track and including (i) a presenting end distal from the chassis, and (ii) a nose track arranged to couple to the central track to provide a continuous track from the chassis to the presenting end; and a removable track coupled to the chassis at the other of the first or second ends of the central track;

the combination of the central track, the nose track, and the removable track co-operating to provide a presenting track that extends from one end of the chassis, through the opposite end of the chassis, and to the presenting end.

9. A media presenter according to claim 8, wherein the presenting track comprises a linear, toothed rack for engaging with a toothed wheel on a movable carriage.

10. A media presenter that is reversible for use with either a front access or a rear access dispenser, the media presenter comprising:

a chassis including a central track defining a coupling at each of two opposing ends;

a removable presenter including a presenter track extending therealong and defining a coupling at one end for engaging with either of the two central track couplings;

a removable track defining a coupling at one end for engaging with either of the two central track couplings; and a carriage moveable along the presenter track, the central track, and the removable track for transporting media.

* * * * *